United States Patent [19]

Perrinelle et al.

[11] 3,940,842

[45] Mar. 2, 1976

[54] DEVICE FOR SLITTING WIENERS FOR BARBECUING

[76] Inventors: Alexandre G. Perrinelle, 631 N. Lafayette Park Place; Edward C. Benjamin, 635 N. Lafayette Park Place, both of Los Angeles, Calif. 90026

[22] Filed: July 28, 1975

[21] Appl. No.: 599,527

[52] U.S. Cl. ..... 30/278; 30/289; 30/290

[51] Int. Cl.[2] ..... B26B 3/00

[58] Field of Search ..... 30/278, 289, 290

[56] References Cited

UNITED STATES PATENTS

| | | | |
|---|---|---|---|
| 2,263,531 | 11/1941 | Kevorkian | 30/278 |
| 3,257,725 | 6/1966 | Dignard | 30/290 |
| 3,465,802 | 9/1969 | Alea | 30/287 |

FOREIGN PATENTS OR APPLICATIONS

| | | | |
|---|---|---|---|
| 187,332 | 10/1922 | United Kingdom | 30/278 |

*Primary Examiner*—Al Lawrence Smith
*Assistant Examiner*—J. T. Zatarga
*Attorney, Agent, or Firm*—W. Edward Johansen

[57] ABSTRACT

The invention is a device for slitting wieners in order to prepare them for barbecuing. The device includes a plastic cylinder having an axial bore of such a diameter that a wiener of commercial size will pass through the bore and the device also includes a plastic blade that has a serrated and curved cutting edge disposed within the bore of the cylinder.

2 Claims, 4 Drawing Figures

DEVICE FOR SLITTING WIENERS FOR BARBECUING

BACKGROUND OF THE INVENTION

1. Field of the Invention

The invention relates to devices used in outdoor cooking and indoor barbecuing, and more particularly to an improved device for circularly slitting wieners.

2. Statement of the Prior Art

In previous years one of the inventors of the present invention has manufactured a device for circularly slitting wieners for outdoor cooking. The device included a wooden cylinder with an axial bore of such a diameter that a wiener could be passed through the bore. The device also included a razor blade disposed within the bore of the cylinder.

In order to manufacture this device a multiple step process was necessary: first, a cylindrical piece of wood had to be cut to the proper length; second, an axial bore had to be drilled; third, the cylindrical piece of wood had to be shaped on a lathe; fourth, a slot had to be cut into the outer surface of the cylindrical piece of wood through it to its inner surface; fifth, a razor blade had to be inserted into the slot and secured therein with a bonding agent such as glue or epoxy. This multiple step process was too expensive and too time consuming for this inventor to continue manufacturing and selling these devices.

The other inventor experimented with several plastic devices including a plastic cylinder with an axial bore in which a plastic blade with a smooth and straight cutting edge is disposed. The plastic blade was not sharp enough to cut through the skin of the wieners so the inventor serrated the edges of the blade in an attempt to find a blade that could saw through the skin. Even though the serrated was able to saw through the skin of the wieners, it did not function inside the plastic cylinder because the cutting edge of the blade distributed its cutting pressure over the entire area of the skin rather than on a small area of the skin of the wieners. The device, as a result of this distribution of cutting pressure, was tearing slits in the wieners rather than cutting slits into the wieners.

The inventors decided that a plastic blade that could cuts slits, rather than tear slits, in the wieners would be ideal because it could be injection molded in a one step process. They rejected an alternative process of injection molding the plastic cylinder with a slot already formed and inserting a razor blade into the slot. This alternative process did not produce a device which eliminated many of the minor problems created by the original device for slitting wieners. The original device was an outdoor cooking implement that was used by the entire family. Children would often cut their fingers on the sharp razor blade inside the cylinder. A plastic blade in unlikely to cut a child's finger. The original device was often left outdoors and therefore its razor blade was exposed to oxidation and the formation of rust on the blade, which dulled the blade and made its replacement necessary. The original device had a tendency to collect organic debris at the interface of the slot and the razor blade thereby making the device a health hazard.

In spite of all these problems the inventor was able to sell as many of the original devices as he could make and he was unable to keep up with the demand because the multiple step process was becoming too costly as were the raw materials.

SUMMARY OF THE INVENTION

In view of the foregoing factors and conditions which are characteristic of the prior art it is a primary object of the present invention to provide a plastic device for slitting wieners which can be economically mass produced.

It is another object of the present invention to provide a plastic device for slitting wieners which does not collect organic debris near its cutting blade.

It is still another object of the present invention to provide a plastic device for slitting wieners which does not tear open the skin of the wiener, but rather cuts into the skin of the wiener.

It is still yet another object of the present invention to provide a plastic device for slitting wieners which can be injection molded in a single step process thereby eliminating the multiple step process used previously by one of the present inventors to fabricate the prior art devices for slitting wieners.

It is yet aother object of the present invention to provide a device for slitting wieners that does not require the use of a metal razor blade whose surface may oxidize to form rust.

In accordance with an embodiment of the present invention a device for slitting wieners includes a plastic cylinder having an axial bore and a plastic blade with a serrated and curved cutting edge which is fixedly joined within the axial bore of the plastic cylinder. The plastic blade is disposed within the axial bore with its cutting edge in a plane which is at an angle of approximately 60° with the axis of the cylinder.

The features of the present invention which are believed to be novel are set forth with particularity in the appended claims.

Other objects and many of the attendant advantages of this device will be more readily appreciated as the same becomes better understood by reference to the following detailed description and considered in connection with the accompanying drawing in which like reference symbols designate like parts throughout the figures.

DESCRIPTION OF THE PREFERRED EMBODIMENT

Figure 1:
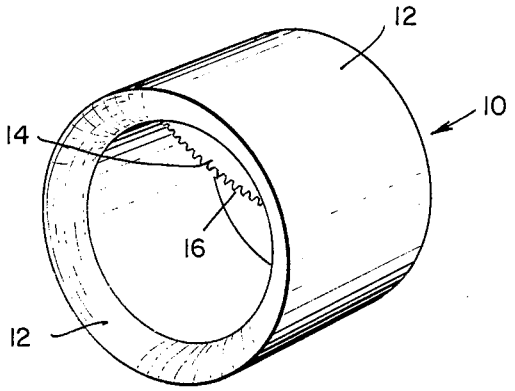
FIG. 1. is a perspective view of the slitting device in accordance with the principles of the present invention.

The preferred embodiment of the present invention can best be understood by reference to FIG. 1 wherein a perspective view of a device 10 for slitting wieners is shown. The device 10 includes a plastic cylinder 12 having an axial bore of such a diameter that a wiener may be passed through it. The device 10 also includes a plastic blade 14 which has a curved and serrated cutting edge 16 and which is disposed within the axial bore of the cylinder 12.

Figure 2:
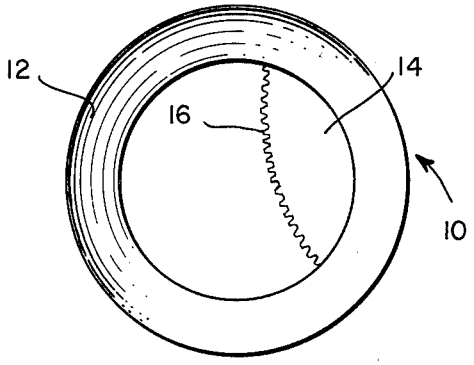
FIG. 2 is a top plan view of the slitting device shown in FIG. 1.

Referring now to FIG. 2 in which the curved and serrated cutting edge 16 is more readily apparent than in FIG. 1, the cutting edge 16 of the blade 14 is serrated in order that it may cut into the skin of the wiener by sawing or tearing the skin. It is also necessary to curve the cutting edge 16 of the blade 14 in order to provide the maximum amount of force on an area of the skin of the wiener to puncture the skin without excessive force. When a razor blade is used the cutting edge is sharp enough so that the force applied against the wiener is not so excessive that it will mash the wiener. The inventor in experimenting with serrated cutting edges of plastic blades that were not curved found that this force required to puncture the skin of the wiener was so excessive that it mashed the wiener.

Figure 3:
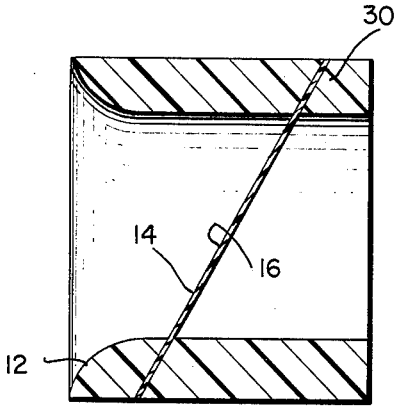
FIG. 3 is a cross-sectional side view of the slitting device shown in FIG. 1.

Referring to FIG. 3 the plastic blade 14 is disposed within the axial bore of the cylinder 12. The plane of the plastic blade 14 makes an angle of approximately 60° with the axis of the cylinder 12. The inventor has found that the angle the plastic blade 14 makes with the axis of the clinder 12 may vary between 40° and 80°.

Figure 4:
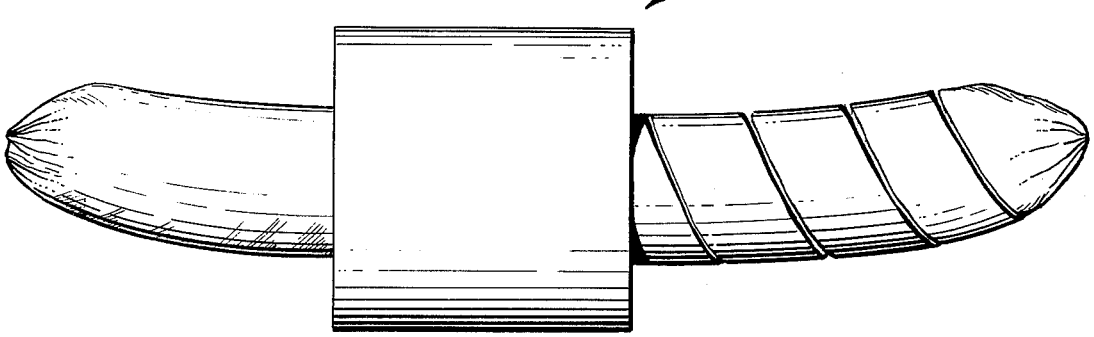
FIG. 4 is a schematic drawing of the slitting device as it is being used to slit a wiener.

Referring now to FIG. 4 a schematic drawing of the device 10 is shown as it is used to slit a wiener for outdoor cooking. One of the advantages of making the device 10 entirely of plastic is that it is very easily cleaned even after prolonged exposure to outdoor elements. This advantage is amplified when one realizes that the razor blade of the prior art devices often became rusty when left outdoors and that organic debris often collected at the interface of the wooden cylinder and the razor blade. The sharp cutting edge of the razor blade has been replaced by a relatively dull cutting edge of a plastic blade thereby decreasing the risk of children cutting their fingers. It is because the plastic blade is curved and serrated that it is able to cut the skin of the wiener.

Another advantage of the present invention is that the entire device can be made from plastic by a single step process of injection molding. This process compares favorably with the five or six step process of the prior art in which a wooden cylinder is formed, a bore drilled, a slot cut, a blade inserted into the slot, and the blade glued in place. The decrease in manufacturing steps reduces costs of making the device. It also reduces the time required to manufacture these devices thereby enabling the inventor to provide their customers with the desired number of these devices. In order for this device for slitting wieners to be commercially feasible, it must be mass produced in large quantities.

Until the present invention there have been no plastic devices for slitting wieners. The advantage of a plastic device includes several health features such as ease of cleaning, a rust-proof cutting edge, a dull cutting edge, and an absence of organic debris on the device. Furthermore, the device may be manufactured in a single step process of injection molding which is not only economical in terms of time and labor costs, but also eliminates material waste.

From the foregoing it can be seen that a plastic device for slitting wieners has been described. The device is used in outdoor cooking. Additionally, it should be noted that the device is not drawn to scale and that relationships of and between the figures of the drawing are not to be considered significant.

Accordingly, it is intended that the foregoing disclosure and showings made in the drawing shall be considered only as illustrations of the principles of the invention.

What is claimed is:

1. A device for slitting wieners so that they may be barbecued, comprising:

a. a plastic cylinder having an axial bore; and b. a plastic blade which has a serrated and curved cutting edge disposed within said axial bore of said cylinder with said blade being in a plane which makes an angle in the range of 40° to 80° with the axis of said cylinder.

2. A device for slitting wieners according to claim 1 wherein said plane makes an angle of approximately 60° with the axis of said cylinder.

* * * * *